US007100214B1

(12) United States Patent
Murray

(10) Patent No.: US 7,100,214 B1
(45) Date of Patent: Sep. 5, 2006

(54) ARTICLE OF CLOTHING WITH A CROTCH PORTION POSITIONABLE BETWEEN OPEN AND CLOSED POSITIONS

(76) Inventor: Gloria Lynn Murray, 4105 Federal Ave., Everett, WA (US) 98203

( * ) Notice: Subject to any disclaimer, the term of this patent is extended or adjusted under 35 U.S.C. 154(b) by 87 days.

(21) Appl. No.: 10/777,827

(22) Filed: Feb. 12, 2004

(51) Int. Cl.
*A41B 9/04* (2006.01)
*A41B 9/00* (2006.01)

(52) U.S. Cl. ..... 2/408; 2/406

(58) Field of Classification Search ..... 2/78.2, 2/405, 406, 408, 234; 450/102–105, 148
See application file for complete search history.

(56) References Cited

U.S. PATENT DOCUMENTS 1,904,228 A 4/1933 Hennessy
2,476,585 A * 7/1949 Cohen ..... 450/105
2,522,008 A * 9/1950 Wohlman ..... 450/105
2,522,009 A * 9/1950 Wohlman ..... 450/105
2,812,516 A * 11/1957 Hoffman ..... 2/80
3,040,751 A * 6/1962 Mastenbrook ..... 450/105
3,224,448 A * 12/1965 Diebold ..... 450/105
4,578,828 A 4/1986 Smith, Sr. et al.
4,597,110 A 7/1986 Smith, Sr. et al.
5,010,595 A 4/1991 Stradley
5,330,598 A * 7/1994 Erdman et al. ..... 156/164
6,192,522 B1 2/2001 Schreib
6,243,878 B1 6/2001 Khemka et al.

* cited by examiner

*Primary Examiner*—Gloria M. Hale
(74) *Attorney, Agent, or Firm*—Christensen O'Connor Johnson Kindness PLLC

(57) ABSTRACT

An article of clothing (30) includes a body-encircling portion (32) having right and left leg portions (34 and 36), and a crotch portion (38). The crotch portion includes a first flap (40) and a second flap (42). Each flap has a free edge (44 and 46) distal from the corresponding right and left leg portions. The crotch portion is positionable between open and closed positions by opening and closing the first and second flaps. When the crotch portion is in an open position, a gap is created in the crotch area between the free edges of the flaps. When the crotch portion is in the closed position, the first and second flaps overlap to form a covering (54) for an external vaginal area of the user. This covering for the external vaginal area of the user is anatomically-compatible.

16 Claims, 4 Drawing Sheets

ARTICLE OF CLOTHING WITH A CROTCH PORTION POSITIONABLE BETWEEN OPEN AND CLOSED POSITIONS

FIELD OF THE INVENTION

The present invention relates generally to articles of women's clothing, and more particularly to articles of women's clothing having crotch portions that are positionable between open and closed positions.

BACKGROUND OF THE INVENTION

Designers and manufacturers of women's clothing have long recognized a need for providing garments which do not need to be removed, either partially or entirely, when it is necessary for a woman to attend to her natural functions.

While men's clothing may have a "fly" that allows a man to relieve himself without removing his clothing, most women's clothing does not have an openable portion in the crotch area that performs a similar function as the fly does for men. For a woman, the act of urinating or attending to personal needs requires removing any clothing covering the lower torso of her body.

An openable crotch is a desirable feature in women's undergarments, especially useful in women's undergarments that are difficult to remove (such as foundation garments or girdles). With regard to underwear, openable crotch garments have generally been designed with little or no closure security at the crotch opening, similar to the fly in men's underwear. Thus, the crotches tend to open on their own without being forcibly opened by a user. However, because the garments are worn underneath an outer layer of clothing, an unintended opening of the crotch is generally of little consequence.

An openable crotch is also desirable in women's clothing that may be worn as outer clothing which itself cannot be removed. For example, a woman might wear this clothing when it is cold and she wants to expose as little skin as possible to the atmospheric elements when relieving herself. Further, a woman might wear this clothing so that she need not partially or completely disrobe to relieve herself, for example, when she is outdoors and away from home or a public restroom. For example, a woman in military field training might use openable crotch clothing. This kind of clothing has generally been designed with zippers or other straight seam closures that are uncomfortable when they rub or bunch up against the external area of a woman's vaginal area.

However, none of the previously-developed openable crotch garments are for use when a woman is engaging in exercise, or otherwise wearing tight-fitting or compression clothing. For example, urinating can be especially difficult and embarrassing for a woman who is, for example, jogging, bicycling, speed-walking, or stretching out in the open in a place where no restrooms are available and other people are around. Further, urinating can also be difficult for people who have trouble removing tight-fitting clothing, for example, if physically impaired or lacking in manual dexterity skills. In these situations, wearing clothing that must be removed to urinate can present an awkward and uncomfortable situation.

Previously developed openable crotches are not comfortable in tight-fitting clothing and/or not secure enough in the closed position to be worn as outerwear. For example, zippers in a straight-seam orientation through the middle of the crotch area and other bulky and/or stiff crotch seams are uncomfortable for a woman when she is engaged in an exercise like bicycling. These straight-seam openings tend to "pucker" and bunch in the crotch area making it uncomfortable for the user. Moreover, underwear without any mechanism for securing the openable crotch in a closed position might spontaneously open to expose a woman's crotch area when she is engaged in athletics.

Therefore, there exists a need for tight-fitting comfortable clothing with a crotch portion positionable in open and closed positions.

SUMMARY OF THE INVENTION

In one embodiment of the present invention, an article of clothing includes a body-encircling portion having right and left leg portions and a crotch portion. The crotch portion includes two flaps, a first flap and a second flap. Each flap has a free edge distal from the corresponding right and left leg portions. The crotch portion is positionable between open and closed positions by opening and closing the first and second flaps. When the crotch portion is in an open position, a gap can be created in the crotch area between the free edges of the flaps. This gap allows a woman to relieve herself without removing the article of clothing. When the crotch portion is in the closed position, the first and second flaps overlap to form a covering for an external vaginal area. This covering for the external vaginal area is anatomically-compatible. In order to create an anatomically-compatible covering, the free edge of the first flap and the free edge of the second flap are distanced away from the centerline of the external vaginal area of the user. Moreover, at least one line segment on the free edge of the first flap and at least one line segment on the free edge of the second flap are not substantially parallel to the centerline of the external vaginal area of the person wearing the article of clothing.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
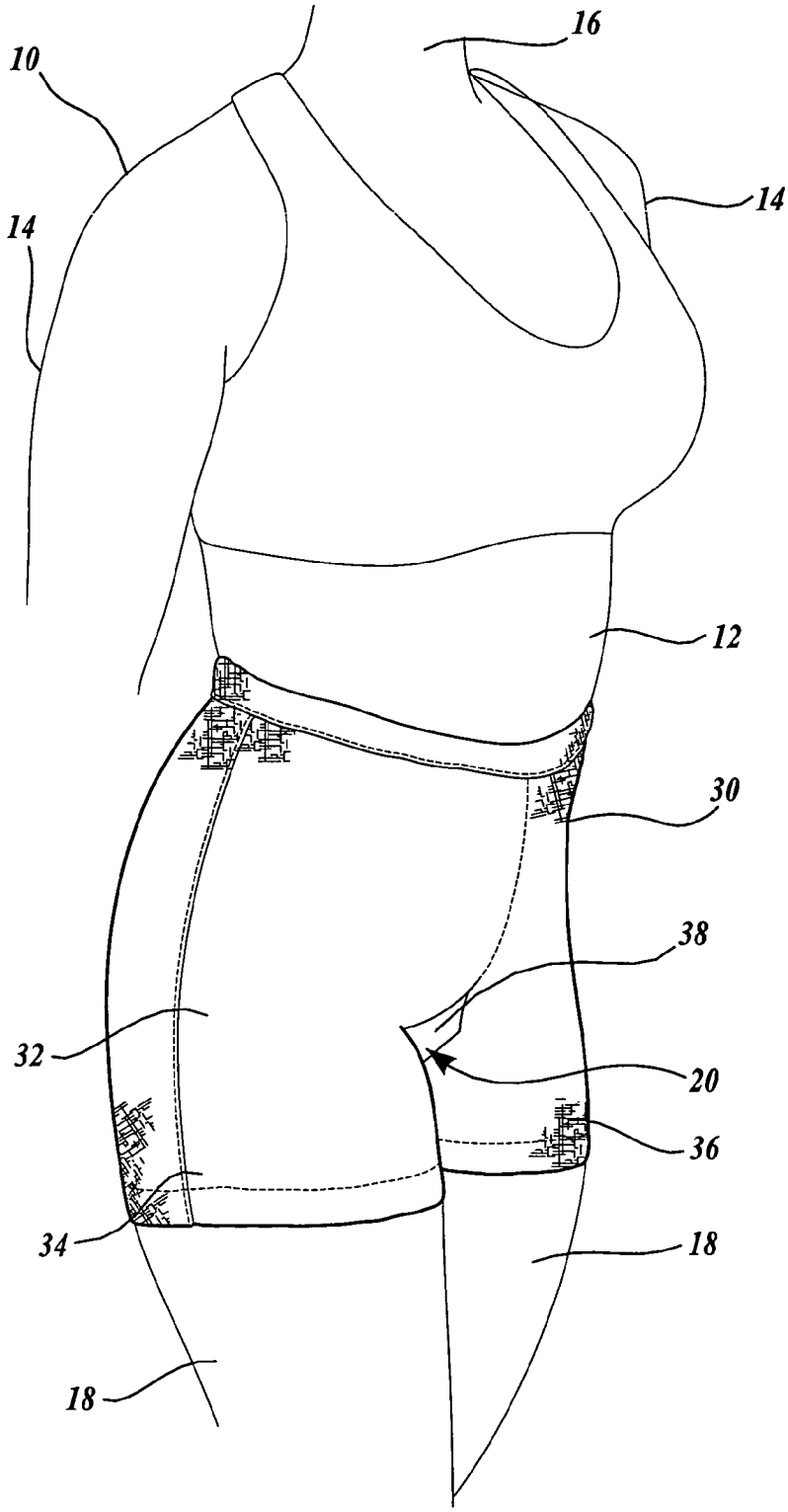
FIG. 1 is a three-dimensional view of a user wearing an article of clothing formed in accordance with one embodiment of the present invention, the article of clothing being worn upon the user's lower torso and having a crotch portion that is positionable in open and closed positions.

As may be best seen by referring to FIG. 1, an article of clothing 30 formed in accordance with one embodiment of the present invention is illustrated. In this embodiment, the article of clothing 30 is suitably shown as a pair of tight-fitting running shorts. For purposes of this detailed description, the term "tight-fitting" means closely conforming to the contours of a body and providing a compression load against the covered portion of the body. Suitable examples of tight-fitting articles of clothing include shorts, pants, tights, body-suits, bathing suits, leotards, foundation garments, girdles, and panty hose. This list is not exhaustive, but merely exemplary of tight-fitting articles of clothing within the scope of the present invention.

The article of clothing herein described is useful when worn during athletic activities, such as jogging, bicycling, speed-walking, horseback riding, hiking, tennis, skiing, aerobics, stretching exercises, or water sports, but is not limited to these athletic uses. This article of clothing, although primarily designed for use by women, may also be used by men.

The article of clothing herein described is also useful as a therapeutic compression device that cannot or should not be removed from the body for long periods of time. The openable crotch portion can also be used as an exit point for a catheter, or other medical apparatuses or personal hygiene products.

Still referring to FIG. 1, the article of clothing 30 includes a body-encircling portion 32. In one embodiment, the body-encircling portion 32 encircles the lower torso 12 of a user 10. In other embodiments, the body-encircling portion 32 may encircle the entire torso 12 and/or limbs, including arms 14, legs 18, neck 16, and head of the user 10.

The body-encircling portion 32 includes a right leg portion 34 and a left leg portion 36. In the illustrated embodiment, the right and left leg portions are what are known as "short" leg portions. Short leg portions have a length at or above the knees of the user. In another embodiment, the right and left leg portions and can be what are known as "long" leg portions. Long leg portions have a length between the knees and the feet of the user. In yet another embodiment, the right and left leg portions can be holes through which the legs 18 of the user 10 extend.

Figure 2:
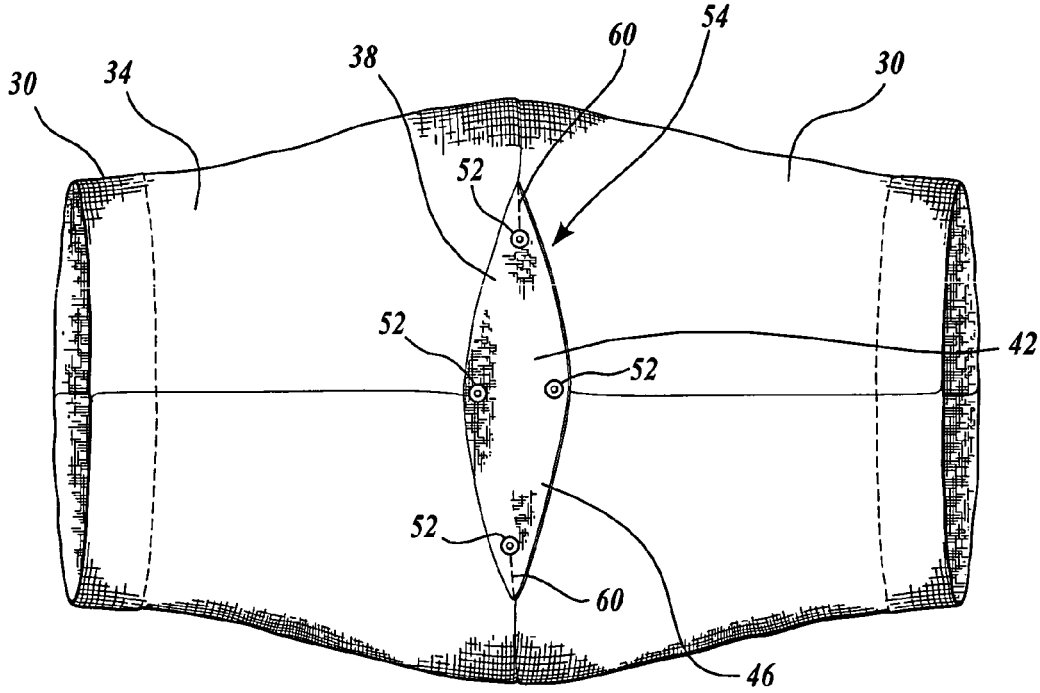
FIG. 2 is a bottom-elevation view of the crotch portion of the article of clothing depicted in FIG. 1, the crotch portion shown in a closed position.
Figure 3:
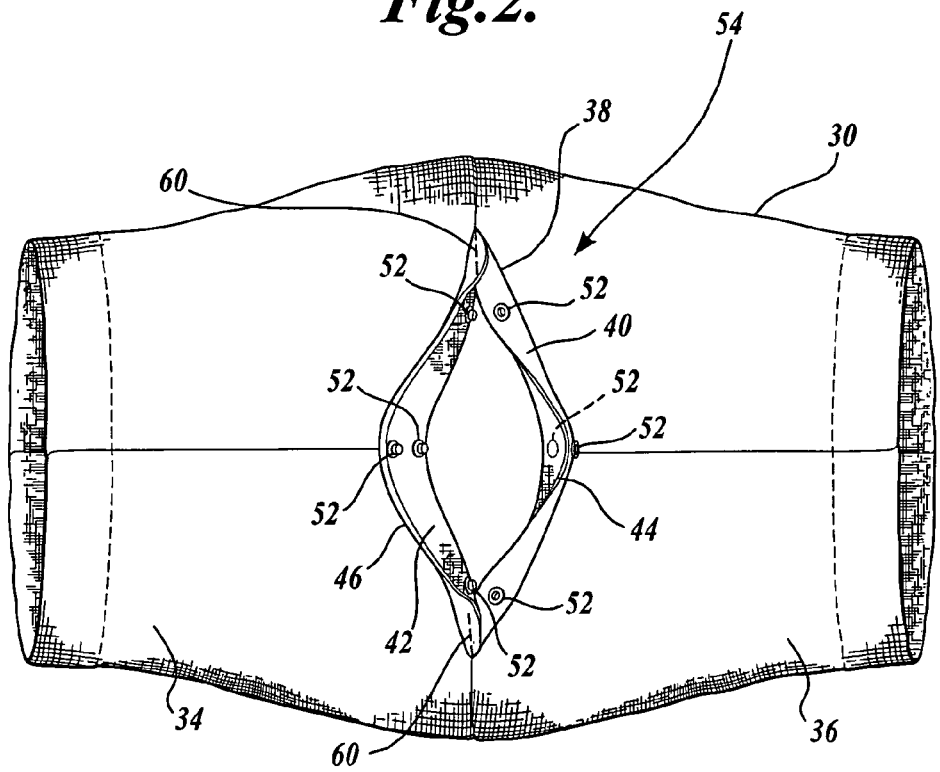
FIG. 3 is a bottom-elevation view of the crotch portion of the article of clothing depicted in FIG. 1, the crotch portion shown in an open position.

Still referring to FIG. 1, the body-encircling portion 32 further includes a crotch portion 38. Referring to FIGS. 2 and 3, the crotch portion 38 includes first and second flaps 40 and 42 both flaps having free or external edges 44 and 46. The free edges 44 and 46 are not attached to, but distal from, the corresponding right and left leg portions 32 and 34. The crotch portion 38 is positionable between closed (FIG. 2) and open (FIG. 3) positions. Referring to FIGS. 1 and 2, when the crotch portion 38 is in the closed position, the first flap 40 is overlapped by the second flap 42 such that the first flap 40 rests in proximity to the external vaginal area 20 of the user and the second flap 42 rests against the outer surface of the first flap 40 to form a covering 54 for the external vaginal area 20 of the user.

The first and second flaps 40 and 42 may have substantially the same shape such that the first flap 40 substantially overlaps and is in registry with the second flap 42. The first flap 40 also may fully overlap the second flap 42.

Figure 4:
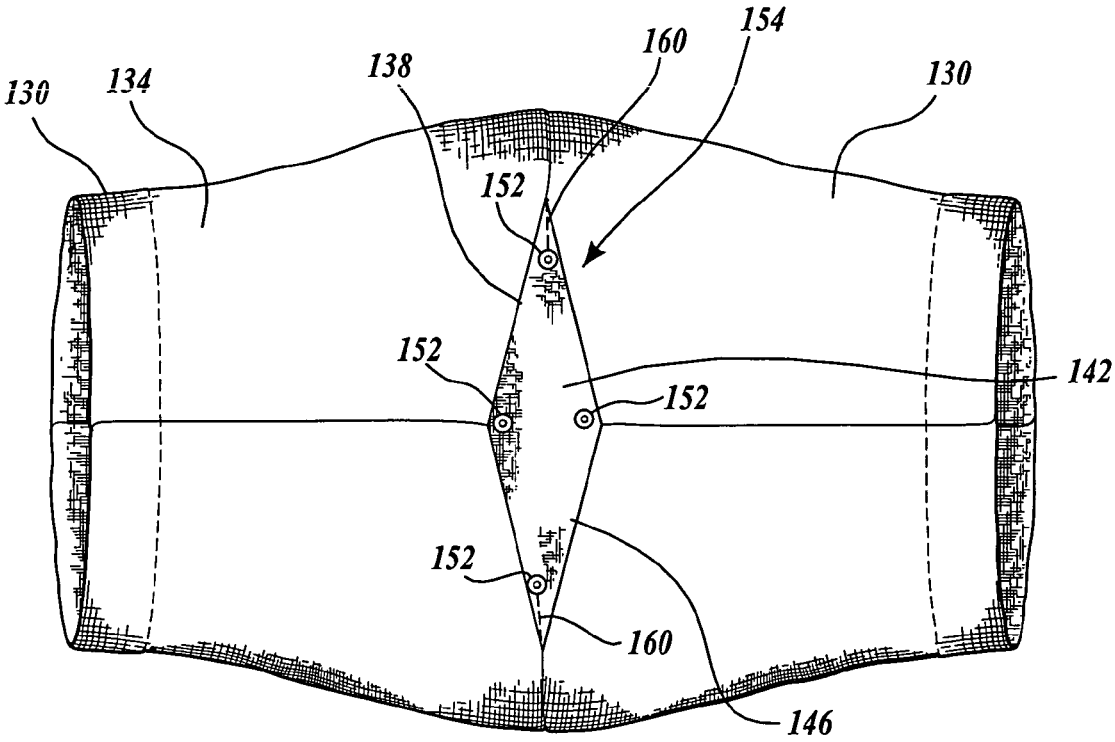
FIG. 4 is a bottom-elevation view of another exemplary embodiment of the crotch portion of the article of clothing formed according to various aspects of the present invention.

The free edge 44 of the first flap 40 and the free edge 46 of the second flap 42 may be displaced from the centerline of the external vaginal 20 area of the user. In the illustrated embodiment, the edges of the first and second flaps 40 and 42 are composed of substantially arcuate line-segments. In other embodiments, the edges of the first and second flaps 140 and 142 may be substantially straight line-segments (see FIG. 4).

Figure 5:
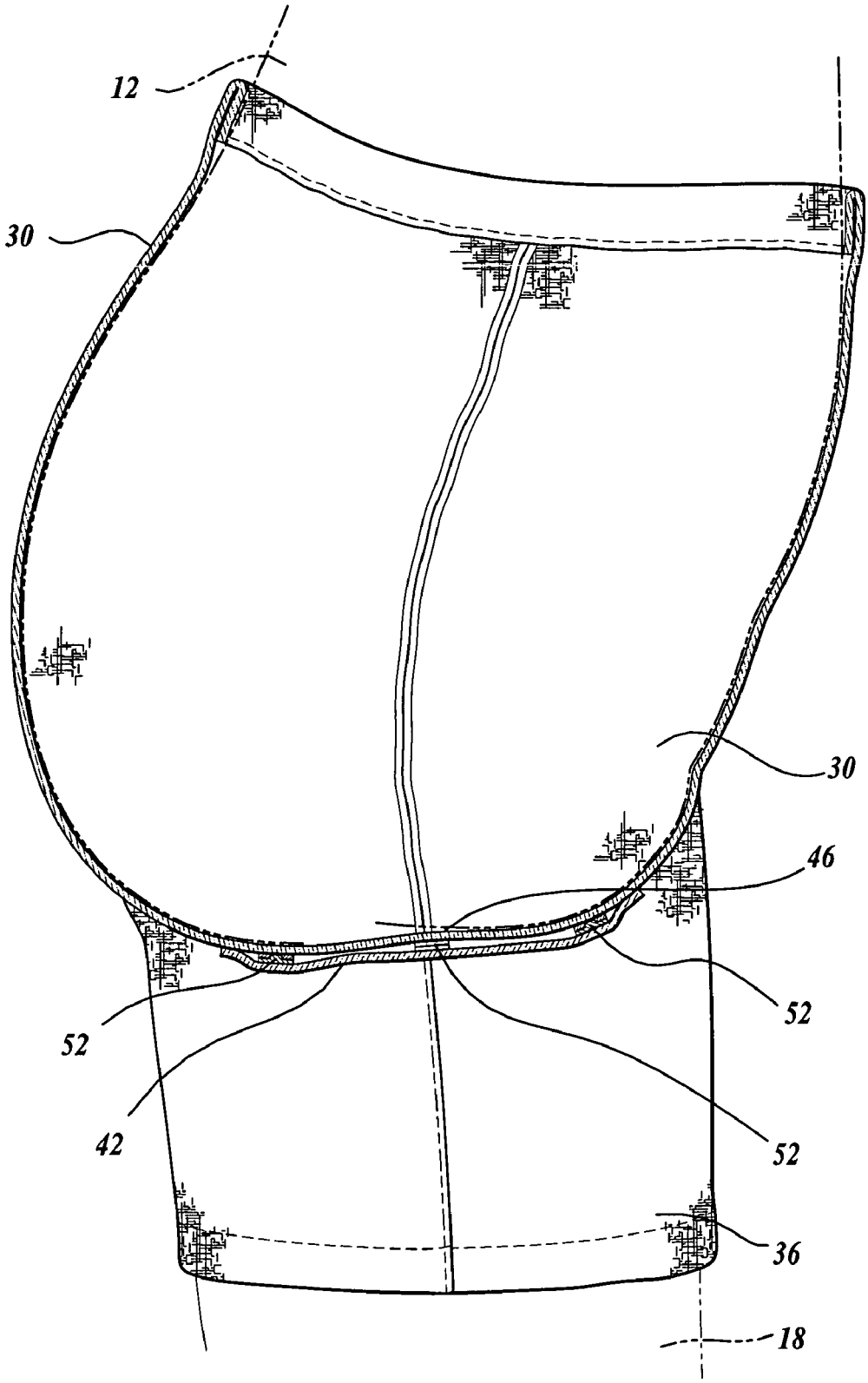
FIG. 5 is a vertical sectional view through the torso of the user of the article of clothing depicted in FIG. 1, the crotch portion shown in a closed position.

Referring now to FIG. 5, the first flap 40 is illustrated as being directly on top of the second flap 42 (i.e., the first flap 40 is inside of the second flap 42) when the crotch portion is in a closed position and the user is in an upright position.

Referring again to FIGS. 1 and 2, the first and second flaps 40 and 42 overlap to form a covering 54 for an external vaginal area 20 of a user. This covering 54 may be an anatomically-compatible covering for the external vaginal area 20 of the user. Anatomically-compatible is defined as fitting the body part or area in a comfortable and proper way, for example, in the way that a sock fits a foot or a glove fits a hand. The first and second flaps 40 and 42 are positioned, shaped, and sized to anatomically fit the external vaginal area 20. To this end, the covering 54 provides a substantially flat and seamless area with which it may directly cover the external vaginal area 20 of the user. When the article of clothing is worn by the user, the covering 54 conforms to the external vaginal area 20 to form a substantially concave, or crescent-shaped, covering with inward roundness against the external vaginal area 20 of the user.

An anatomically-compatible covering 54 includes a substantially flat and seamless area that directly covers the external vaginal area 20 of the user. Still referring to FIGS. 1 and 2, the substantially flat and seamless area of the covering 54 protects the external vaginal area 20 of the user when the crotch portion 38 is in a closed position. For purposes of this detailed description, the external vaginal area 20 includes the labia majora (or the outer pair of lips) of the vagina and the outer organs of the vagina. When the crotch portion 38 is in a closed position, the free edges 44 and 46 of the first and the second flaps 40 and 42 are spaced laterally outward from the centerline of the vaginal area of the user to ensure that the covering 54 does not have a seam disposed along the centerline of the external vaginal area 20 of the user. Moreover, when in a closed position, at least one line segment of the free edge 44 of the first flap 44 and at least one line segment of the free edge 46 of the second flap 42, are not substantially parallel to the centerline of the external vaginal area 20 of the user. The edges of the anatomically-compatible covering 54 may be spaced outward from the external vaginal area 20 so that they may generally lie at the crease between a woman's upper thigh and pelvic area. By spacing the free edges 44 and 46 of the first and second flaps 40 and 42 from the centerline of the vaginal area, the seams are impeded from entering the labia majora or causing irritation to the sensitive areas of the external vaginal area 20.

The first and second flaps 40 and 42 may be polygonal-shaped, curved, or curved-linear. Polygonal-shaped flaps include, but are not limited to, quadrilaterals, diamonds, parallelograms, and squares. Curved flaps include, but are not limited to, ellipses and circles. Curved-linear flaps include, but are not limited to, arcuate or leaf-like coverings.

The covering 54 is further positioned, shaped, and sized to prevent chafing or rubbing along the inner thigh, including thigh-to-thigh friction or thigh-to-seam friction. In some articles of clothing, a low crotch (one that is positioned between the thighs instead of directly against the vaginal area) will not prevent friction and chafing between the upper inner thighs as they come in contact and rub together. In other articles of clothing, a straight-seam crotch or a bunched crotch that runs along the centerline of the vaginal area of the user may cause friction and chafing when in direct contact with the external vaginal area. Further, a bunched crotch may not allow the vaginal area to breathe and may provide a breeding ground for vaginal area infections, such as a yeast infection. A straight-seam zipper crotch is disclosed in U.S. Pat. No. 6,243,878 to Khemka et al., and a straight-seam snap-fastened crotch is disclosed in U.S. Pat. No. 2,812,516 to Hoffman, these patents incorporated herein by reference in their entirety.

The crotch portion 38 is normally biased in a closed position to fully cover the external vaginal area 20 of the user. To open the crotch portion 38, a user spreads the first and second flaps 40 and 42 apart to create an opening. In some instances, the crotch portion 38 may open slightly if the user positions herself with her legs apart in a wide-legged stance or sitting position. When the crotch portion 38 is in an open position, the body encircling portion 32 still includes two distinct right and left leg portions 34 and 36.

One advantage of the present invention is that when the crotch portion 38 is in the open position, a user may urinate without removing her clothing or soiling her clothing. In addition, another advantage of the present invention is that a user can sit on or squat over a toilet seat that may seem unclean (such as a public toilet seat) without touching the toilet seat. When the crotch portion 38 of the clothing is in the open position, the user can sit on the toilet seat and urinate into the toilet. In this manner, the clothing provides a protective layer between the user and the toilet seat.

In the illustrated embodiment, stitching 60 joins overlapped portions of the first and second flaps 40 and 42 along the outer path of the free edge 46 of the second flap 42 and the attached edge 48 of the first flap 40. In one embodiment, stitching 60 along the overlapped edges of the first and second flaps 40 and 42 helps bias the first and second flaps 40 and 42 in a closed position. Even with the bias of the stitching 60 in this embodiment, the crotch portion 38 still may be positioned in an open position when desired.

In the illustrated embodiment, the first and seconds flaps 40 and 42 include fastening devices 52 for securing the first and seconds flaps 40 and 42 in the closed position. The fastening devices may include, but are not limited to, zippers, buttons, a hook and loop fastening system, and two-member snap fasteners with male and female members. The fastening devices can be placed in any number of arrangements that preferably provide comfort as well as a secure closure.

In the illustrated embodiment, four snap fasteners 52 are coupled to the first and second flaps 40 and 42 and arranged on the flaps so that they are positioned, when the crotch portion 38 is in a closed position, outside the labia majora or other sensitive areas of the external vaginal 20 area of the user. The female snap members can be sewn on the first flap and the male snap members can be sewn on the second flap, or vice versa. In other embodiments, less than four snap fasteners may be arranged on the first and second flaps. In other embodiments, more than four snap fasteners may be arranged on the first and second flaps.

The covering 54 is sufficiently secure such that the user need not wear underwear beneath the clothing or worry about the covering 54 opening when the user is engaged in any activity, including strenuous exercise. Moreover, the covering 54 is sufficiently secure, sized, and shaped to support a female sanitary napkin. The crotch portion 38 can be sized such that when it is in an open position, the user can easily change, remove, or put a sanitary napkin in place.

The size of the covering 54 may vary depending on a number of factors, such as the size of the article of clothing itself, the activity that the article of clothing is recommended for, and whether the clothing is designed for women or for children. The size of the covering 54 may also vary if it is for foundation garments, girdles, or panty hose, compression garments, or clothing for the physically impaired. Further, the size of the covering 54 may vary if it is designed to be incorporated or adapted to existing garments. The length of the first and second flaps can be between about 3 inches and about 12 inches. The width of the first and second flaps can be between about 1 inch and about 6 inches. In one embodiment, the length of the first and second flaps is about 6 inches and the width of the first and second flaps is about 1.5 inches. The length to width ratio of the crotch portion can be between about 1 to 1 and about 12 to 1. In another embodiment, the length to width ratio of the crotch portion can be between about 2 to 1 and about 6 to 1.

This article of clothing also may be stretchable in addition to being tight-fitting. To create the tight-fitting and stretchable effects, the article of clothing may be manufactured from elastic-blend materials, such as stretchable elastane/Spandex® and cotton fiber blends that are abrasion resistant, strong, and have a soft hand, or may include other polyamide, polyester, cotton, wool and/or silk fiber blends. The article of clothing also may be manufactured out of neoprene or other buoyant materials, as in the case of body-suits worn for water activities. These fiber blends are only exemplary, and not exhaustive.

While the preferred embodiment of the invention has been illustrated and described, it will be appreciated that various changes can be made therein without departing from the spirit and scope of the invention.

The invention claimed is:

1. An article of clothing comprising:

a body-encircling portion having right and left leg portions and a crotch portion, the crotch portion comprising a first flap and a second flap each having a free edge, the crotch portion being positionable between open and closed positions, wherein when the crotch portion is in the closed position, the first and second flaps substantially entirely overlap one another to form a covering for an external vaginal area of a user, the free edge of the first flap and the free edge of the second flap are displaced from a centerline of the external vaginal area of the user, and at least one free edge is not substantially parallel to the centerline of the external vaginal area of the user.

2. The article of clothing of claim 1, wherein the crotch portion is normally biased in the closed position.

3. The article of clothing of claim 1, wherein the crotch portion is positionable in the open position by an external force.

4. The article of clothing of claim 1, wherein the free edges of the first and second flaps are composed of straight line-segments.

5. The article of clothing of claim 1, wherein the free edges of the first and second flaps are composed of arcuate line-segments.

6. The article of clothing of claim 1, wherein the first and second flaps are polygonal in shape.

7. The article of clothing of claim 1, wherein the first and second flaps are curved in shape.

8. The article of clothing of claim 1, wherein the first and second flaps are curved-linear in shape.

9. The article of clothing of claim 1, wherein the crotch portion is secured in a closed position by a fastener.

10. The article of clothing of claim 1, wherein the crotch portion is secured in a closed position by a plurality of snap fasteners.

11. The article of clothing of claim 1, wherein the body encircling portion is tight-fitting.

12. The article of clothing of claim 1, wherein the body encircling portion is stretchable.

13. The article of clothing of claim 1, wherein the crotch portion has a length to width ratio of about 2 to 1 to about 10 to 1.

14. The article of clothing of claim 1, wherein when the crotch portion is in an open position, the body-encircling portion has right and left leg portions.

15. An article of clothing comprising:

a body-encircling portion having right and left leg portions and a crotch portion, the crotch portion comprising a first flap and a second flap each having a free edge, the crotch portion being positionable between open and closed positions, wherein when the crotch portion is in the closed position, the first and second flaps substantially completely overlap one another to form a covering for an external vaginal area of a user, wherein the covering is anatomically-compatible.

16. An article of clothing comprising:

a body-encircling portion having right and left leg portions and a crotch portion, the crotch portion comprising a first flap and a second flap each having a free edge, the crotch portion being positionable between open and closed positions, wherein when the crotch portion is in the closed position, the first and second flaps substantially completely overlap one another to form a covering for an external vaginal area of a user, wherein the covering is a substantially flat and seamless area that covers the external vaginal area of the user.

* * * * *